United States Patent [19]

Jones

[11] Patent Number: 4,582,293

[45] Date of Patent: Apr. 15, 1986

[54] HYDRAULICALLY OPERATED VALVES

[75] Inventor: Marvin R. Jones, Houston, Tex.

[73] Assignee: Koomey Blowout Preventers, Inc., Houston, Tex.

[21] Appl. No.: 337,383

[22] Filed: Jan. 6, 1982

[51] Int. Cl.[4] ..... E21B 33/06

[52] U.S. Cl. ..... 251/1.3; 251/1.1; 251/77; 251/287

[58] Field of Search ..... 251/1 A, 1 R, 77, 84, 251/287; 92/156, 158

[56] References Cited

U.S. PATENT DOCUMENTS

| | | | |
|---|---|---|---|
| 931,228 | 8/1909 | Schutte . | |
| 1,064,660 | 6/1913 | Klee | 251/84 |
| 1,157,870 | 10/1915 | Houser . | |
| 1,836,506 | 12/1931 | Rasmussen et al. | 251/1 |
| 2,177,164 | 10/1939 | Baash | 251/1 |
| 2,795,391 | 6/1957 | Krone et al. | 251/38 |
| 2,883,141 | 4/1959 | Oliver | 251/1 |
| 2,946,550 | 7/1960 | Wilde | 251/1 |
| 3,036,807 | 5/1962 | Lucky et al. | 251/1 |
| 3,216,334 | 11/1965 | Bauer | 92/158 |
| 3,285,287 | 11/1966 | Curran | 137/630 |
| 3,318,577 | 5/1967 | Banks | 251/332 |
| 3,601,157 | 8/1971 | Milleville | 137/630.14 |
| 3,612,476 | 10/1971 | Leitgeb | 251/38 |
| 4,024,884 | 5/1977 | Prescott et al. | 251/38 |
| 4,253,638 | 3/1981 | Troxell, Jr. | 251/1 A |
| 4,266,468 | 5/1981 | Biggs | 92/158 |

OTHER PUBLICATIONS

*Composite Catalog*, 1974–1975, p. 1034, 1980–1981, pp. 1440–1442 and 5216.

*Primary Examiner*—Martin P. Schwadron
*Assistant Examiner*—Sheri M. Novack
*Attorney, Agent, or Firm*—Vaden, Eickenroht, Thompson & Jamison

[57] ABSTRACT

There is disclosed a ram type blowout preventer in which the chambers in which the rams are received and for movement between opened and closed positions are automatically vented to the bore of the preventer housing above the closed rams, as the rams are moved to open position, in order to equalize pressure across the ram and thus facilitate its opening. When the rams are moved to closed position, this vent is closed so that well pressure beneath the closed rams has access through a groove between the ram and the ram chamber to the chamber behind the closed rams so as to assist operating fluid in maintaining them closed. The stem which connects a piston of a hydraulic system for operating the rams is hollow and so arranged as to be pressure balanced whereby there is substantially no force due to well fluid pressure resisting closing movement of the rams due to the extension of the rod sealably through an opening in a wall separating the ram chamber from the cylinder of the hydraulic system.

38 Claims, 12 Drawing Figures

19
18
21
20
29
28
46
27
30A
17
47
30
G
45
30B
25
26
12

44
40
18
19
10
28
43
20
56
31
70
106
104
103
14

61
62
G 41
22
19
21
11
17
31
61
12
27
30B
2B
2B
62
G
26

HYDRAULICALLY OPERATED VALVES

This invention relates generally to valves and other flow controlling apparatus, and especially to double gated valves, such as blowout preventers used in the drilling and completion of oil and gas wells, wherein the double gates or rams of the preventer are caused to move into face-to-face engagement with one another to close off the bore through the housing in which the gates or rams are received. More particularly, it relates to improvements in such valves or other flow controlling apparatus, and especially blowout preventers or other double gated valves, in which the closure member of the valve, or gates or rams of the preventer, are moved between opened and closed positions by means of fluid operated piston rods extending sealably through walls in the housing separating chambers in which the closure member or rams are received from the cylinders in which the pistons reciprocate.

In the drilling of oil and gas wells, blowout preventers are often stacked or mounted one above the other so that, with the upper preventer closed, well fluid acts over the cross-sectional areas of the piston rods for the rams of the lower preventer to provide a force resisting their movement to closed position. Hence, it has been necessary to use pistons which are so large that the force due to operating hydraulic fluid for closing the rams may squeeze the rubber packing carried on the front faces of the ram bodies so tightly that the packing is caused to wear prematurely due to movement of the pipe within the pipe recesses of the packing.

Preventers of this type are also conventionally provided with grooves between the lower sides of the rams and the chambers in which they are received so as to connect the bore beneath the closed rams with the ram chambers behind them, whereby, with the rams closed, well fluid is effective over at least part of the area on the outer ends of the rams to provide a force which supplements hydraulic operating pressure in maintaining their rams closed. However, this further increases the pressure in the ram packing by a multiple dependent on the ratio of the areas of the ram front packing and the outer end of the ram over which well fluid is effective. Furthermore, the large pistons necessary to provide an opening force for overcoming this supplemental force due to well fluid may be even larger than would otherwise be necessary to close the rams.

As shown in Lucky et al Pat. No. 3,036,807, it has been proposed to reduce the force required to open the rams by providing the rams with passageways which connect the ram chamber on the outer end of each ram with the bore of the preventer housing above as well as below the closed rams, and controlling flow through the passageways in order to connect the chamber with the bore beneath the closed rams, upon inward movement of the piston rod to close the rams, and connect the chamber with the bore above the closed rams in order to vent the chamber and thereby balance pressure across the ends of the rams, upon outward movement of the piston rod to open the rams. However, in the preventer shown in the Lucky et al patent, this requires a shuttle valve which is connected to the inner end of the piston rod and reciprocable within a valve chamber formed in the ram body to provide a lost motion connection therewith. This not only complicates construction of the rams, but also makes it difficult if not impossible to remove and install the rams for replacement or repair independently of the actuators.

In other types of valves, passageways in the closure member which connect a chamber on the outer side of the closure member with the bore or flowway of the valve housing upstream and downstream of the closure member are selectively opened and closed by a valve head on the inner end of the rod of the actuator which has a lost motion connection with the closure member. Although this suggests a less complex arrangement for controlling flow between the chamber and the passageways than the shuttle valve of Lucky et al, it suggests nothing which would simplify removal and replacement of the closure member with respect to the actuator.

In some valves of this latter type, the passageway connecting a chamber behind the outer end of the closure member with the flowway downstream of the closure member, in its closed position, is of greater cross-sectional area than the passageway connecting such chamber with the flowway upstream of the closure member. Hence, the pressure drop between the chamber and the flowway on the upstream side of the closure member, at least during "initial" opening movement of the operating rod, is greater than between the chamber and the flowway on the upstream side of the closure member so that line fluid provides a force which assists that of operating fluid in initially urging the valve to open position. However, as in the case of the above-mentioned valves, removal and replacement of the closure member is complex and difficult, and particularly unsuited for blowout preventers.

In the blowout preventer disclosed in Lucky et al Pat. No. 3,036,807, another rod extends from the outer end of the operating piston for sliding sealably through a wall separating the cylinder from an outer chamber in the bonnet. More particularly, both rods and the piston have a hole therethrough and are of substantially pressure same cross-sectional area, so that rods are substantially balanced to eliminate or substantially reduce any force due to well fluid which must be overcome by the operating fluid in moving the rams to closed position.

It is also desirable to lock preventer rams such as those of Lucky et al in their closed positions, and the simplest and preferred way of doing this is by means of lock screws carried by the bonnet for movement into and out of locking engagement with the piston or other part of the actuator. However, when the rams of the Lucky et al preventer are closed, the shuttle valves on the inner ends of the piston rods close the venting passageway connecting the chamber with the bore above the closed rams, and well fluid from the bore beneath the closed rams enters the outer chamber. Since the pressure of well fluid beneath the closed rams may be quite large, it may create a large force resisting movement of a lock screw into locking position within the outer chamber of the Lucky et al preventer. Also, drilling mud from the preventer bore is free to pass into the outer, balance chamber of the Lucky et al preventer and thus have access not only to the seal through which the rod on the outer end of the piston extends, but also to the seal about the lock screw.

An object of this invention is to provide a valve, and especially a ram type blowout preventer, in which flow between the chamber and the bore on the upstream and downstream sides of the closure members or rams is controlled in the manner above described, but in which the closure member or ram and its actuating rod are of such construction as to facilitate quick and easy removal and installation of the ram or other closure member, and, in the case of a blowout preventer, of such construction as to require only relatively minor modifications in and to rams as compared with conventional rams.

Another object of this invention to provide such a valve, and especially a blowout preventer, wherein an operating rod for controlling flow between the chamber and bore above and below the closed rams is essentially pressure balanced, as described, but in such a manner as to provide only minimal resistance to inward movement of lock screws to ram locking positions.

Still another object is to provide such a valve, and especially a blowout preventer, of the type described in which drilling mud or other line fluid is excluded from the balance chamber in order to protect seals by which such chamber is maintained fluid tight.

Although it is conventional practice for the hydraulic operators for both rams of a blowout preventer of this type to operate in response to hydraulic fluid provided from a common source, the rams will not move in unison toward closed position—i.e., one will reach its closed position prior to the other. This ram movement is ordinarily limited by engagement of the operating piston with the inner end of its cylinder. More particularly, due to the wear of the ram front packings, which protrude from the inner ends of the ram bodies on which they are carried, an effort is made to so relate the operating system to the rams as to permit the ram front packing of either ram to move inwardly a predetermined distance past the centerline of the bore of the preventer housing. However, due to tolerances, including those between the piston and cylinder, it may be found that one or both rams will be permitted to move an even further position beyond the centerline of the housing bore. As a result, the rams, in closing upon a pipe, may move the pipe a substantial distance to one side of the centerlinthe preventer bore. This problem would, of course, be accentuated in a preventer such as above described in which the piston rods have lost motion connections with the rams. Although it has been proposed to provide some means other than the operating system for limiting inward movement of the rams, and thereby overcoming the aforementioned tolerance problem, these suggestions have required substantial modification of the preventer.

It is therefore still another object of this invention to provide a blowout preventer in which inward closing movement of the gates or rams is limited to a desired extent by means which requires little or no modification to the preventer, and, more particularly, occupies existing unused space in the preventer.

It has also been proposed to use the operating system for opening and closing the rams in further moving the rams out of the bonnet when the bonnet is moved away from the main body of the preventer, in order to permit the rams to be lifted from connection with the operating rods. Thus, in the preventer illustrated and described on page 5216 of the 1980–81 *Composite Catalog,* the bonnets are hingedly connected to the main body of the preventer so that, when the rams are withdrawn into the bonnets, they may be swung to one side, and the rams then moved inwardly and thus out of the bonnets by the hydraulic system which moves them between opened and closed positions. The fluid conduits of the hydraulic system which connect an external source of hydraulic fluid with opposite sides of the operating pistons are formed in the main body and bonnets of the housing, as well as in the hinges pivotally connecting them to one another. More particularly, the interconnecting conduits are so constructed and arranged that each bonnet is interchangeable with the other regardless of the side of the main body of the housing to which it is connected, thereby minimizing inventory requirements. Although the provision of such conduits within the housing avoids the use of external conduits, which may be extremely inconvenient in the environemnts in which blowout preventers are used, their arrangement is such that they require time-consuming and expensive machining operations. Also, when the bonnets are disconnected from the main body of the housing and swung to open position, their weight imposes a large load on the hinge pins which makes it difficult to swing the bonnets about the pins.

It is therefore a still further object of the invention to provide such a preventer having bonnets connected to a main body of the housing by hinges having conduits which are easier and less expensive to form and machine.

Yet a further object is to provide such a preventer in which the bonnets are easier to swing between opened and closed positions.

Rams of the type described comprise a metallic body which is shaped to move axially within the ram chamber, and which has recesses formed across its front face, its sides, and over its top, to receive packings which, when the rams are moved to closed positions, form a continuous seal between opposite rams and between each ram and its ram chamber, and, of course, about a pipe in the bore of the preventer housing in the case of pipe rams. More particularly, the front face portions of the packing protrude from the metallic body of the ram so as to continue to seal with respect to one another, despite wear, and provide an excess of packing material to cause the side and top portions of the packing to be deformed against the adjacent walls of the ram chamber as the front faces of the ram packings are moved into tight engagement with one another.

The ram front packing portion of each ram includes a body of rubber-like material having relatively shallow recesses formed in the top and bottom thereof adjacent its inner end or face, and metallic retainer plates molded within the recesses with their inner edges substantially flush with the inner edges of the packing body of rubber-like material to prevent the packing material from being extruded between the front faces of the metallic body of the ram as the protruding portions of the packing are forced into engagement with one another. In the case of pipe rams, each of the ram body and packing, including the retainer plates and body of the packing, is provided with a generally semi-circular recess to receive one half of the pipe in the bore of the preventer housing. The recess in the packing body protrudes from the recesses in the retainer plates so as to fit tightly about the pipe as the rams are moved into closed positions. Thus, there is an excess amount of rubber-like material to form a tight seal against the pipe even as the rubber-like material is worn during use of the preventer, and particularly by virtue of movement of pipe within the recess. As this excess rubber-like material becomes worn, the retainer plates, and thus the axially aligned semi-circular recesses in their inner edges, are perxitted to move rearwardly with respect to the metallic body of the ram so as to insure tight sealing engagement between the rubber-like material and the pipe even after wear occurs.

Thus, in fabricating the ram front packing, it has been proposed to mold pins within the packing body at each side thereof, with the ends of the pins fitting within the outer ends of elongated slots in the adjacent side portions of the retainer plates, so as to permit some rearward movement of the plates with respect to the packing as wear occurred. It was found, however, that, in the molding of the packing, portions of the elongated slot in front of pins filled with rubber, which interferred with free movement of the retainer plates until the excess material was worn away.

As shown on pages 1440–1442 of the 1980–81 *Composite Catalog,* it has also been proposed to mold inserts into the packing body wherein pins of the type previously mentioned have their opposite ends received closely within holes in the retainer plates, but in which rods extending rearwardly from the pins have slots on their inner sides. Pins for securing the top packing in the top recess in the ram body are received in the rear ends of the slots, whereby the retainer plates are free to move rearwardly with the pins to the extent provided by the slots. However, in order to replace the ram front packing, it's first necessary to lift the top packing, and thus the downwardly extending pins in the top packing from the slots in the rods of the inserts in the ram front packing. Furthermore, it's necessary to mill slots in the rearwardly extending rods of all the ram front packings, which are of relatively short life and thus require relatively frequent replacement.

As shown in U.S. Pat. No. 2,883,141, it has also been proposed to guide a pipe in the bore of the housing into axial alignment therein, as the rams are moved inwardly to seal about the pipe, by means of inner edges on each retainer plate on opposite sides of the pipe recess therein which slant in opposite directions with respect to each other as well as with respect to the inner edges of the other retainer plate. More particularly, the edges slant at the same angle with respect to a plane perpendicular to the axis of movement of the ram, so that opposed rams are complementary—i.e., interchangeable with one another for installation in either ram chamber. Although serving their intended purpose to guide the pipe into an axially aligned position within the bore of the preventer housing, since these edges extended across the entire width of the ram, they substantially increased the stroke required in the operating system for moving the out of the ram chambers in the bonnets for replacement or repair.

As shown on page 1034 of the 1974–75 *Composite Catalog,* it has also been proposed to slant only the portions of the ram faces adjacent each side of the pipe recess, with the remaining portions thereof being perpendicularly to the axis of movement of the rams. However, even in this case, in preventers in which the rams are received in bonnets hingedly connected at one side to a main body of the preventer housing, the outer end portion of the ram chamber formed in the main body of the preventer housing must be enlarged to a substantial extent in order to clear the sides of the rams remote from the pivotal axis of the hinge.

It is therefore still another object of this invention to provide a ram as well as a ram front packing portion of the type described, which is of such construction that the retainer plates are free to move rearwardly with respect to the main metallic body of the ram, without interference by portions of the rubber-like body of the ram packing which must be worn away with use, and further without having to first remove the top packing portion of the ram, or having to perform machine operations on the inserts of the ram front packing.

It is yet a further object of the present invention to provide a ram and a ram front packing of the type described having retainer plates with slanted inner edge portions which are so formed as to guide a pipe into the axis of the bore of the preventer housing, but which reduce the extent to which the outer end of the ram chamber in the main body of the housing must be enlarged in order to clear the rams as the bonnets in which they are contained swing between opened and closed positions.

These and other objects are accomplished, in accordance with the illustrated embodiment of the invention, by a ram type preventer of the type described wherein a passageway in the ram connects the ram chamber on its outer end with the bore of the preventer housing above (or downstream) of the ram, and a valve head on the inner end of the rod of the operating piston engages with a seat on the ram about the opening of its passageway into the ram chamber so as to close the passageway, as the ram is moved inwardly, and moves away from the seat so as to open the passageway, as the rod is moved outwardly. More particularly, there is another rod on the operating piston which has an outer end extending sealably through a wall of the housing separating the cylinder from an outer balance chamber in the housing, and a hole extends through the piston and both of the rods to connect the outer chamber with the ram chamber when the passageway is open and to connect the outer chamber with the bore of the preventer housing above the closed rams when the passageway is closed. Consequently, in the closed position, well fluid from the relatively low pressure side of the closed rams acts over opposite ends of the piston and its rods, and thus within the outer chamber, whereby there is relatively little resistance due to the pressure of well fluid in the outer chamber to prevent a locking screw mounted on the housing from moving inwardly into the balance chamber to engage the outer rod in order to lock the ram in closed position.

In accordance with another novel aspect of the invention, a fitting is carried by the lock screw for injecting grease into the outer chamber and the hole through the rods and pistons, and a plug is slidable within the hole to separate the well fluid from the grease, and thus prevent the intrusion of well fluid into the outer chamber, while sliding axially within the hole in response to movement of the outer rod as well as the locking screw into and out of the balance chamber. More particularly, the volume displaced by the plug in moving between its inner and outer positions is substantially equal to that displaced by each of the outer rod lock screw upon movement within the balance chamber.

The outer diameters of the rods which extend sealably through the housing walls are substantially equal, so that the rods are essentially pressure balanced, and the operating system including the piston and cylinder, and the operating fluid requirements, are relatively small. Also, an annular packing is carried by the valve head on the inner end of the operating rod to engage the seat about the end opening of the ram passageway along an inner diameter which is substantially equal to the outer diameters of the rods which extend sealably through the housing walls. As a consequence, there is little or no force to urge the operating piston and its rods in either direction, whether the passageway in the ram is opened or closed.

The housing comprises an inner body in which the bore and inner ends of the ram chambers are formed, bonnets in which the outer ends of the ram chambers are formed, and hinge pins connecting the bonnets to the housing for movement between closed positions and open positions in which the rams may be moved inwardly to positions removed from the bonnets. More particularly, the lost motion connections between the rams and operating rods comprise vertically interfitting parts on the inner ends of the rods and the rams which permit the rams to be lifted from connection with the inner ends of the rods when so removed from the bonnet. In the preferred and illustrated embodiment of the invention, the interfitting connecting means between the valve head on the operating rod and the rams comprise "T" slots in the back face of each ram on opposite sides of the passageway therethrough, and cooperating "T"'s carried by the valve head on opposite sides of the operating rod.

In accordance with still another novel aspect of the invention, stops on each ram and its chamber are arranged to engage one another within the groove formed between the lower side of each ram and its chamber to fluidly connect the bore beneath the closed rams with the chamber on the outer side of the ram, such groove either being formed in the ram or in the chamber, as is well known in the art. More particularly, the stops are so arranged as to prevent inward movement of the front face of each ram body substantially beyond the centerline of the bore, so that the protruding portion of the front face packing extends therebeyond. This aspect of the invention is particularly useful when, as previously mentioned, the hydraulically operable means for reciprocating the rams includes a piston rod having a lost motion connection with the ram for moving the ram inwardly with the rod to closed position and outwardly with the rod to open position. Thus, even in this instance wherein the margin for overtravel might otherwise be expected to be greater than if there was no such lost motion connection between the operating rod and the ram, the stops limit inward travel of the rams themselves, independently of travel of the operating rod.

In accordance with a still further embodiment of the present invention, conduits means formed within the main body and bonnets of the housing as well as in the hinge pins for connecting them to one another include conduits in the bonnet leading to the cylinders of the operating system which connect with holes in which the hinge pins are received midway of the upper and lower ends of the holes. Thus, these single conduits connect with conduit means in the hinge pin and thus in the main body of the housing regardless of which side of the bonnet is above or below the other, and thus regardless of which side of the main body the bonnet is connected to In addition, each bonnet is caused to rotate with its hinge pins, whereby the hinge pins are connected to rotate within holes in the main body of the preventer housing, by means of a set screw which is mounted on the bonnet for movement into and out of a depression in the hinge pin. More particularly, and consistent with interchangeability of the bonnets, the set screws are also located midway of the top and bottom sides of the bonnets. In addition to fixing the bonnets against rotation with respect to the hinge pins, the set screws hold the hinge pins against vertical movement in the aligned holes of the main body and bonnets of the housing.

In accordance with still another novel aspect of the present invention, each of a pair of fittings molded into opposite sides of the front packing of the pipe rams includes a pin having its opposite ends extending into the recesses in the top and bottom sides of the rubber-like body of the ram front packing and fitting closely within holes in the retainer plates, together with an additional pin fixedly connected to the first-mentioned pin and having one end projecting from the inner side portion of the ram front packing. More particularly, the projecting ends of the latter pins are received within the inner ends of elongated slots in the adjacent side portions of the recesses of the metallic body of the ram in which the side portions of the ram front packing are closely received, whereby, as the ram front packing body within the recess thereof becomes worn, the retainer plates are free to move rearwardly with respect to the metallic body of the ram in order to continue to perform their intended function. In order to install or remove the ram front packing upon the ram body, it is merely necessary to spread the side portions of the ram front packings sufficiently to move the projecting ends of the pins into or out of the elongated slots in the ram body, whether or not the top packing is in place. As will also be appreciated, there is no occasion for the slot in the ram body to fill with rubber.

In accordance with still another novel aspect of the present invention, the inner edges of one retainer plate of each ram include portions which, on one side of the pipe recess, slant in a direction from the recess to one side of the ram, inwardly and then outwardly at an acute angle with respect to a plane perpendicular to the axis of movement of the ram, and, on the other side of the recess, in a direction from the recess to the other side of the ram, slant outwardly and then inwardly at the same angle to said plane. More particularly, the inner edges of the other retainer plate slant in opposite directions, but at the same acute angle, so that the guiding edges on opposed rams are complementary to one another. Due to the slant of the laterally outer portions of the edges of the plates, the arc about which the side each ram most remote from the hinge axis must swing is lessened considerably, so that the outer end of the ram chamber portion within the main body of the preventer housing need be enlarged to a lesser extent than heretofore in order to clear the ram as the bonnet is swung between opened and closed positions.

In the drawings, wherein like reference characters are used throughout to designate like parts:

Figure 1:
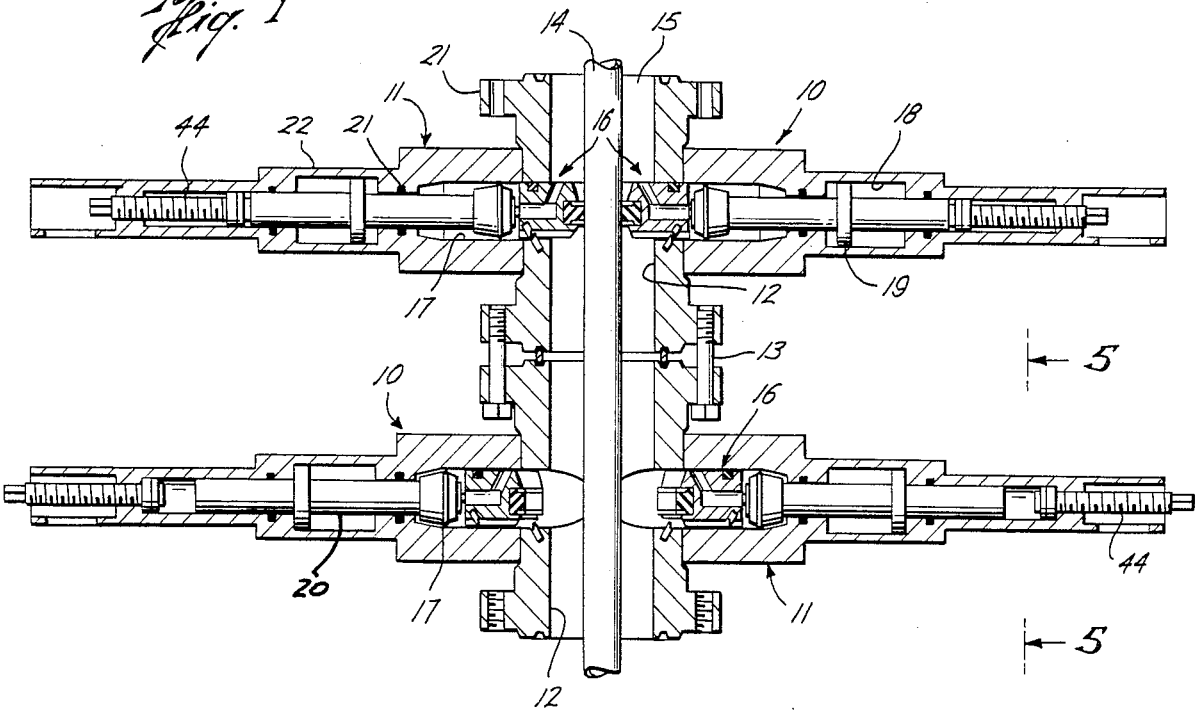
FIG. 1 is a vertical sectional view of a wellhead including a pair of vertically stacked, ram-type blowout preventers constructed in accordance with the present invention, with the rams of the upper preventer closed about a pipe in the aligned bores of the preventer housings, and the rams of the lower preventer being withdrawn to open the annular space between the pipe and the bores.
Figure 5:
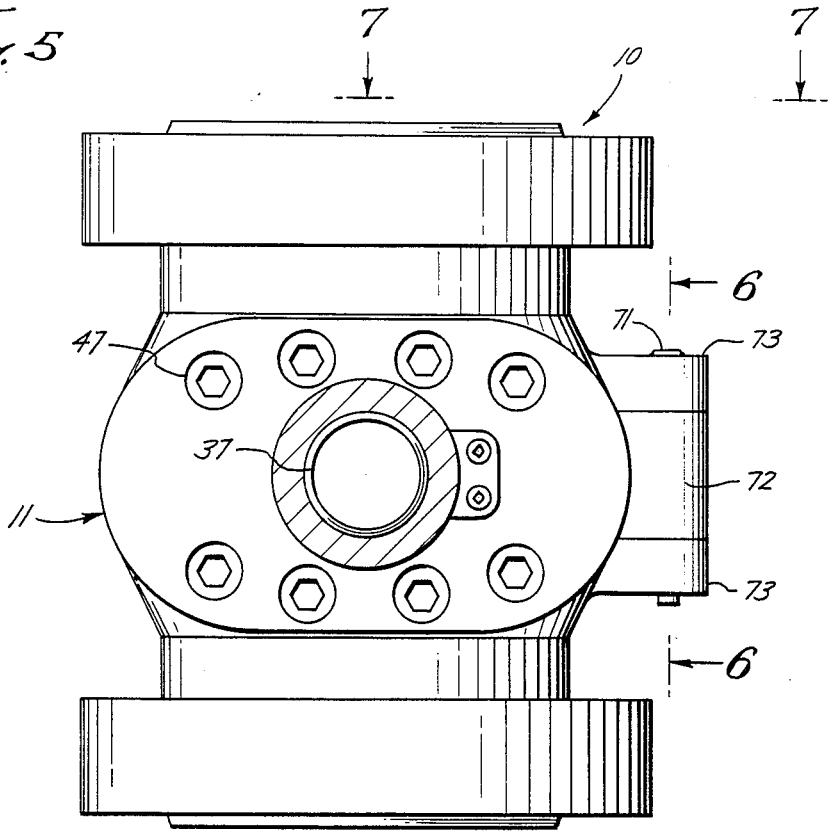
FIG. 5 is an enlarged end view of the lower preventer, as seen along broken lines 5—5 of FIG. 1.

With reference now to the details of the above-described drawings, the upper and lower, vertically stacked preventers shown in FIG. 1, and indicated in their entireties by reference character 10, comprise housings 11 having vertical bores 12 therethrough which are axially aligned, when the preventers are stacked one above the other, and bolted together, as at 13. As shown, a pipe 14 extends upwardly from the well and through the aligned bores of the preventer, which would ordinarly be a drill pipe through which drilling fluid may be circulated downardly into the well bore and then returned upwardly within the annulus 15 between the pipe and the bores of the preventer stack.

Each preventer also includes a pair of rams 16 which are received within chambers 17 intersecting opposite sides of the housing bores 12. As described, the rams are adapted to be moved within the chambers between outer positions in which they are withdrawn into their chambers so as to open the bore, and thus, in the case of the lower preventer, permit flow through the annulus, and inner positions in which they engage about the pipe and with one another in order to close off the annulus, as in the case of the upper preventer. As will be understood, with the rams of the upper preventer closed, the pressure of well fluid beneath them, and thus within the chambers 17 in which the rams 16 of the lower preventer are received, may be quite high.

Each ram is moved between opened and closed position by means of a cylinder 18 formed in the housing outwardly of each ram chamber, a piston 19 reciprocable within the cylinder, and a rod 20 extending from the piston and sealably through a packing or seal 21 carried within an opening through a wall of the housing separating the ram chamber from the cylinder. As will be described, hydraulic fluid from an external source may be supplied to or exhausted from the cylinder on opposite sides of the piston for reciprocating the piston and thus moving the ram toward and away from the bore. The force due to the operating fluid for closing the ram is opposed by an oppositely directed force due to well fluid acting over the cross-sectional area of this rod to urge the ram to open position.

Each housing 11 comprises a main body 21 in which are formed the bore 12 of the housing and the inner end of the chamber 17 in which each ram are received. The housing also includes a pair of bonnets 22 each pivotally connected at one side to the main body 21, in a manner to be described, and having the cylinder 18 of the ram operating system formed in its outer end outwardly of the outer end of the ram chamber which is aligned with the inner end of the chamber when the bonnets are in closed positions.

Each ram comprises a metallic ram body 25 of generally oval cross section, and packing of rubber-like material carried by the ram body for sealing with respect to the other ram and about a pipe disposed with the housing bore, as well as with respect to the chamber 17 in the preventer housing so as to form a continuous seal for closing the bore. Although the illustrated rams are provided with a semi-circular recess in their front faces cooperating with a similar recess in the other ram to closely receive the pipe, in other cases, the rams may be of the "blind" type in which their front faces extend straight across for sealing against one another when the bore is empty. In either event, the packing includes a front face portion 26 having rear extensions on each side and received closely within a recess extending across the front and sides of the ram body 25, and a top portion 27 which is received with a recess over the top side of the ram body which extends from one side to the other of the side extensions of the front face packing to circumscribe an area across the upper front face and front end of the top of the ram.

As is also true in the case of certain types of commercially available preventer rams, each ram body 25 is provided with a groove G in its lower side which connects the bore of the housing on its inner end with the chamber 17 on the outer end of the ram. In this way, well fluid pressure from the bore of the preventer housing is at all times effective over the outer end of the ram in the chamber so that, as will be described, with the rams moved to closed position, well fluid pressure provides a force in addition to that of operating fluid to hold the rams in such positions. That is, with the rams closed, the pressure of the well fluid within the bore of the preventer above the rams acting over the area on its inner top side and upper front face circumscribed by the continuous packing is relatively low, as compared with the well pressure below the closed rams and thus in the chamber 17 behind the rams.

Figure 2:
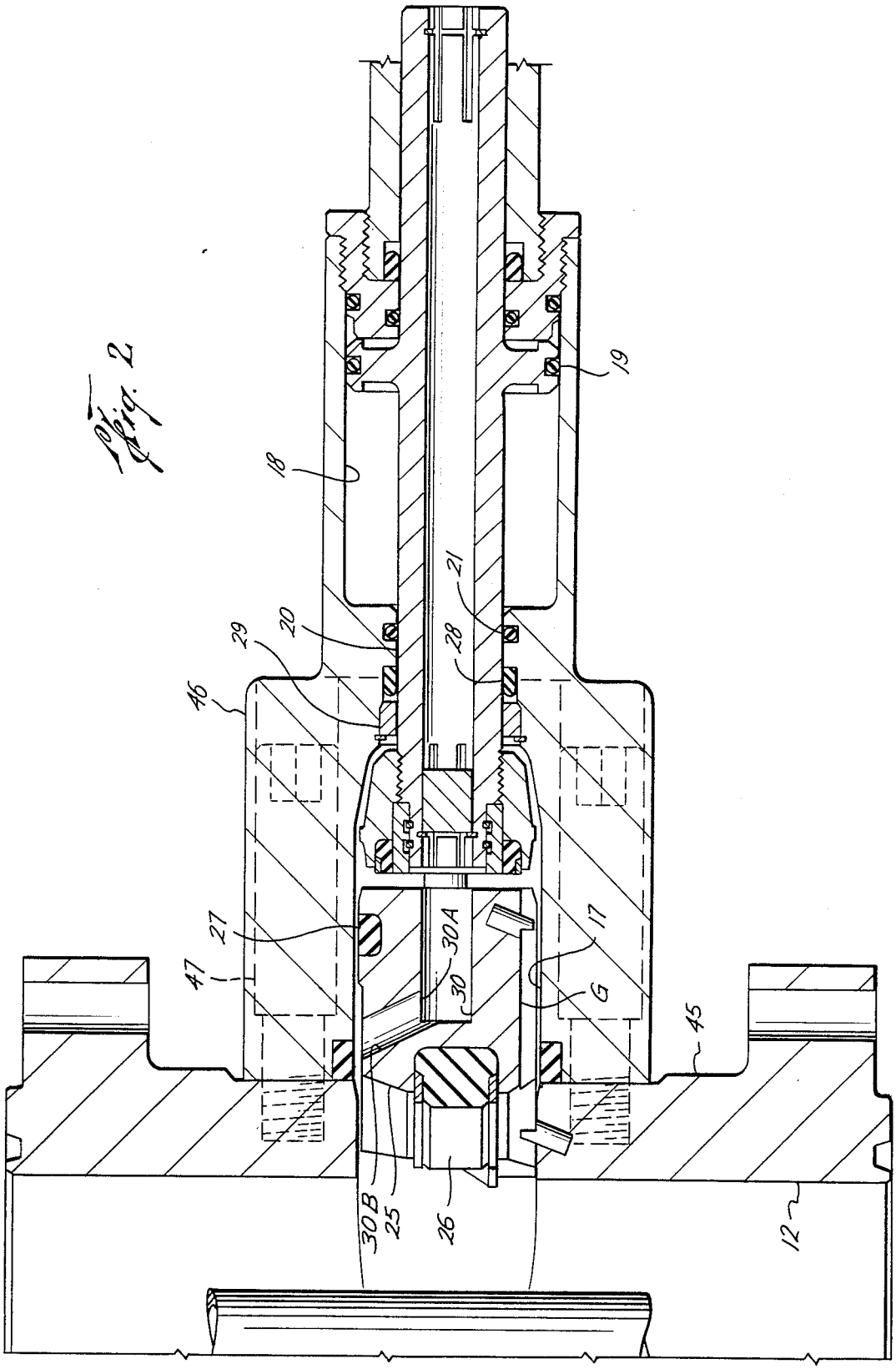
FIG. 2 is an enlarged vertical sectional view of one side of the lower blowout preventer of FIG. 1, with the ram in such one side moved to open position, and with the inner of the operating rod for so moving the ram spaced from the outer end of the ram passageway.

As best shown in FIG. 2, the seal ring 21 within which the piston rod 20 is slidable is carried within a groove in the housing wall which separates ram chamber 17 from cylinder 18. As shown in FIG. 2, an additional packing 28 may be carried within a counterbored portion of the rear end of the ram chamber and held in place by means of a ring 29 providing an additional seal about the rod.

In accordance with one novel aspect of the present invention, a passageway 30 is formed in the ram body to connect its outer end with the upper inner portion thereof circumscribed within the continuous packing so as to connect the ram chamber 17 with the bore of the preventer above the closed rams. As shown in FIG. 3, for example, the passageway 30 is made up of a central bore 30A which opens to the outer end of the ram in axial alignment with piston rod 20, and a pair of upwardly and inwardly extending branches 30B which connect with the top side of the ram generally intermediate its inner end and the top packing 27 extending thereacross, and on opposite sides of the longitudinal centerline of the ram body.

Figures 3A, 3B:
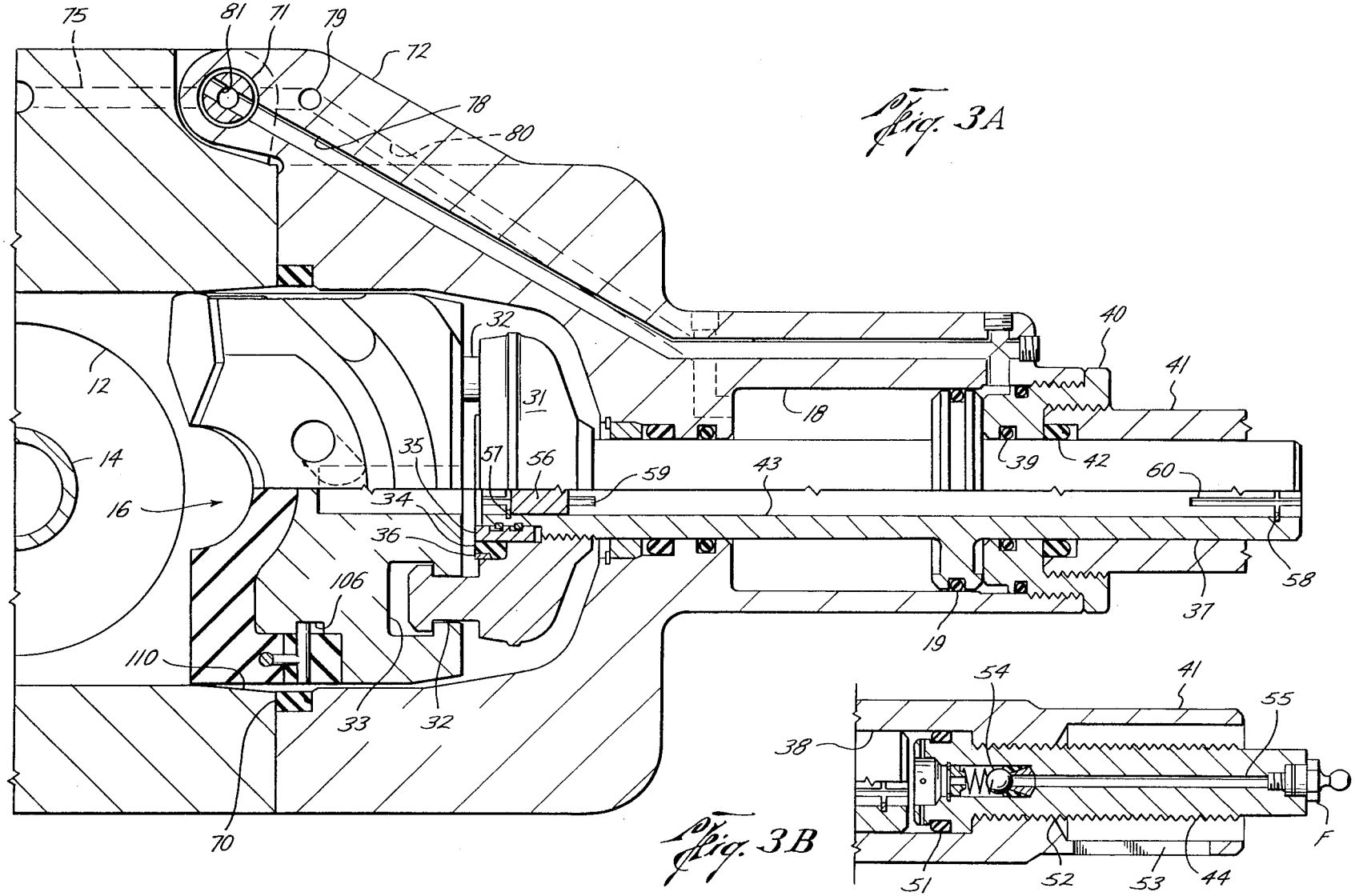
FIG. 3A is a horizontal sectional view of the one side of the blowout preventer shown in FIGS. 2 and 2A, with the rams withdrawn to the open position of FIG. 2.
FIG. 3B is a horizontal section view of the outer end of the one side of the preventer housing shown in FIG. 3A, and with a lock screw withdrawn to an outer position in the outer chamber of the housing.

The inner end of rod 20 within chamber 17 has an enlarged head 31 which extends laterally substantially the entire width of the ram chamber and has "T"'s 32 projecting from its inner end on each side of the rod for fitting within "T" slots 33 formed in the rear side of the ram body on opposite sides of passageway 30. More particularly, slots 33 extend upwardly from the lower side of the ram body and terminate generally midway its upper and lower sides so that, with the rams withdrawn, as shown in FIG. 3A, the ram may be interconnected with the rod 30 by lowering the "T" slots onto the "T"'s, and removed from the rod by lifting of the "T" slots from the "T"'s. More particularly, the neck of each "T" 32 is longer than the reduced neck of the "T" slot 33, so that each "T", and thus the valve head and piston rod, have lost motion with respect to the ram.

An annular packing 34 is carried by the inner end of the valve head intermediate the "T"'s 32 in axial alignment with rod 20, and protrudes from the front end of the valve head 31 so as to be movable in engagement with a seating surface on the rear end of the ram body which surrounds the opening of bore 30A of the passageway 30 to the rear end of the ram in order to close the passageway. Thus, as the rod is moved forwardly with respect to the ram, due to the lost motion connection between the rod and ram, packing 34 will sealably engage the seating surface of the ram to close the passageway. Alternatively, when the rod is moved outwardly with respect to the ram to the extent of the lost motion connection, packing 34 is lifted from the seating surface so as to open the passageway 30 and thus connect the ram chamber on the outer side of the ram within the bore of the housing above the closed rams. As shown, packing 34 is carried on a retainer ring 35 releasably connected to the front end of the valve head, and includes an anti-extrusion ring 36 about the outer diameter of the rubber body thereof.

As also previously described, another rod 37 extends outwardly from piston 19 and sealably through a wall or reduced diameter portion of the housing separating cylinder 18 from an outer chamber 38 within the housing. Thus, a seal ring 39 is carried within a groove in a nut 40 forming the outer end of cylinder 18, and a closed end tubular member 41 is carried by and extends from the nut to form the chamber 38. Packing 42 may be carried within a groove in the inner end of tubular member 41 to form an additional seal about the rod 37. As previously mentioned, and as will be described to follow, well fluid acting over the forward end of the rod 20 is admitted to the outer chamber 38 so as to act over the rear end of the rod 37 and thus counterbalance at least part of the force which would otherwise have to be overcome in opening the rams.

Figures 2A, 2B, 4:
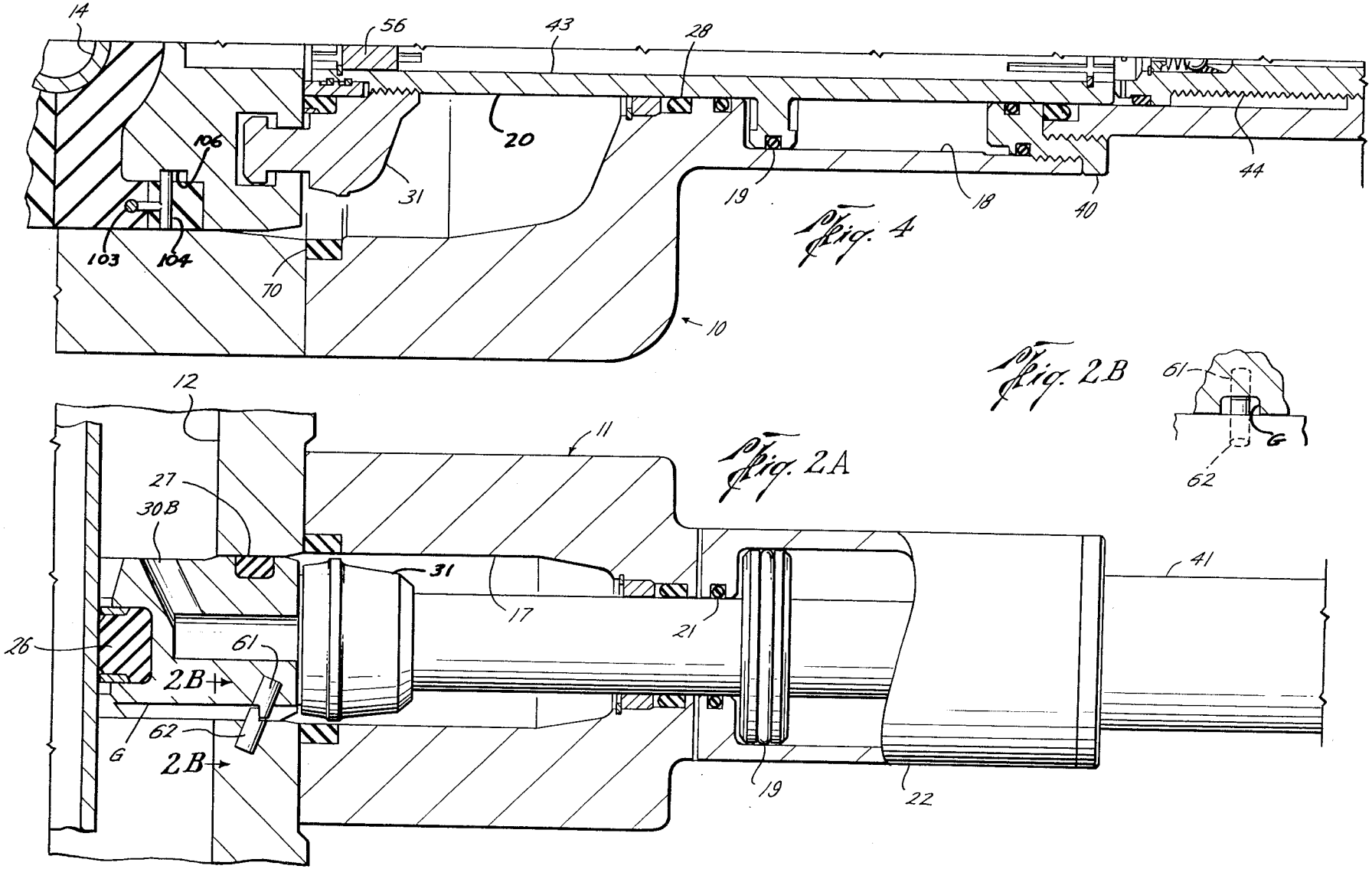
FIG. 2A is a view similar to FIG. 2, upon movement of the operating piston and rod inwardly to move the ram inwardly about a pipe in the housing bore, and with such inward movement limited by engagement of pins on the chamber and ram, and within the recess between them.
FIG. 2B is a vertical sectional view of a portion of the preventer, as seen along broken lines 2B—2B of FIG. 2A, showing the ends of the engaged pins.
FIG. 4 is a horizontal sectional view of one half of one side of the preventer, similar to FIG. 3A, but with both rams moved to closed positions, as in FIG. 2A, and the lock screw moved inwardly to lock the right hand ram in closed position.

More particularly, a hole 43 is formed through both rods 20 and 37 as well as piston 19 so as to connect the inner end of rod 20 within packing 34 with the outer end of rod 37. Preferably, the above-described seal rings within which rods 20 and 37 are slidable are of equal diameter so that, with the valve head 31 moved outwardly with respect to the ram, as shown in FIG. 3A, well fluid within the bore of the preventer is effective over equal areas on opposite ends of the rods to pressure balance same and thus eliminate any force tending to move the rod inwardly or outwardly. In addition, the packing 34 carried by valve head 31 is of substantially the same inner diameter as the seals through which rods 20 and 37 are slidable, so that, when the valve head is moved inwardly to cause packing 34 to sealably engage the seating surface on the outer end of the ram, as best shown in FIG. 4, the rods are also pressure balanced as the rams are moved to closed position. That is, the normally higher well fluid within the bore of the preventer beneath the closed rams will be effective over the area formed by the inner diameter of packing 34, while the relatively low pressure within the bore above the closed rams will be effective over an inner area defined by the same diameter, so that the rod is pressure balanced whether the passageway is open or closed.

As shown in FIG. 3B, a lock screw 44 is mounted on the outer closed end of tubular member 41 of the housing for movement within outer chamber 38 between the outer position of FIG. 3 and the inner position of FIG. 4 in which it locks the rams in closed position. As previously described, inasmuch as the pressure within the chamber 38 into which the lock screw is moved is that of well fluid within the bore of the preventer above the closed rams, it provides relatively little resistance to inward movement of the lock screw.

Viewing now the overall operation of the preventer, and assuming that it is desired to move the rams from open position to closed position, hydraulic operating fluid is admitted to the cylinder 18 rearwardly of the piston 19 and exhausted therefrom forwardly of the pistons to cause the operating rod 20 to move inwardly. As just described, inasmuch as the rod is pressure balanced, the force necessary for so moving the rod is merely that required to overcome the weight and frictional resistance of the ram, so that operating fluid requirements are minimized. In any event, due to the lost connection provided by the T's and T-slots on the valve head and ram, the rod first moves forwardly to engage packing 34 carried by valve head 31 with the seating surface on the rear end of the ram surrounding passageway bore 30A to close the fluid connection of passageway 30 with the chamber 17. Upon continued inward movement of the rod, the ram is moved inwardly until the recess 26 on its front face to fits about the pipe in the bore. If the opposite ram has already been moved to closed position, as determined by the aforementioned stops, the front face of the packings on opposite sides of the recesses of both rams will sealably engage one another to close the preventer bore. Thus, as described, the ram front packings protrude from the front face of the metallic ram body to not only seal about the pipe and with one another, but also cause the side packings and top packings of the rams to protrude into sealing engagement with the ram chambers. With the rams in closed position, and the ram passageway 30 closed by seal rings 34 on the valve heads, the relatively high pressure well fluid beneath the closed rams is effective over a substantial area of the rear ends of the rams to provide a force which supplements the closing force of operating fluid in maintaining the rams closed.

As previously described, stops provided to limit inward movement of each ram comprise pins 61 press fitted into holes in the lower sides of the rams to dispose their lower ends in the groove in the bottom of the ram, and pins 62 press fitted into holes in the preventer housing with their upper ends extending into the same groove inwardly of pins 61. More particularly, and as can be seen from FIG. 2A, an inwardly facing surface on the lower end of pin 61 and an outwardly facing surface of the upper end of pin 62 are so arranged as to engage and thereby prevent further inward movement of the right hand ram when the inner faces of the metallic body of the ram are disposed within a vertical plane passing through the axis of the preventer bore. Although the pipe will be moved slightly off center, due to the fact that such ram will move inwardly before the left hand ram, the extent of offset will be no more than the protrusion of the ram front packing, and, in any event, will lessen as the ram front packings become worn. As previously described, due to the disposal of the interengaging ends of the stop pins within the groove in the bottom of the ram, no additional space is required within the ram. As shown, the holes in which the pins are received are angled to facilitate drilling of the bore to receive pins 62 from the outside of the main body of the preventer housing.

When it is desired to open the rams, operating fluid is admitted to the cylinders 18 on the inner sides of the pistons while being exhausted from the outer sides thereof so as to withdraw the rods. During initial outward movement of the rods, packing 34 is lifted from the seating surface on the rear end of the ram so as to open the passageway 30 in the ram and thus vent high pressure well fluid in the ram chamber behind the ram to the bore of the preventer housing above the closed rams. As previously described, the cross-sectional area of each passageway 30 is substantially larger than the cross-sectional area of the groove G in the bottom of each ram which connects its inner end with the ram chamber, so that the high pressure well fluid is quickly vented from the chamber at the rear of each ram to cause a pressure differential across the ram to urge it open during initial withdrawal of the operating rod. The rams will of course continue to be withdrawn as piston 19 moves to its outermost position within the chamber 18, as shown in FIG. 2.

As shown in FIGS. 3A and 4, a packing 51 is carried about the inner end of the lock screw for sliding sealably within outer chamber 38 so as to prevent loss of pressure within the chamber as the screw is moved into and out of the chamber. As shown in FIG. 3B, the tubular member 41 has an outer extension to protect the threads 52 of the lock screw in the outermost position thereof. The longitudinal position of the lock screw may be determined with ease through a window 53 formed in the outer extension of the tubular member.

As previously described, a fitting F is carried by the lock screw so as to permit grease to be injected into the outer chamber 38 and at least part of the hole 43 through the rods and piston in order to exclude drilling mud from entry into the chamber 38. As is common in the art, a ball check valve 54 is spring pressed to a closed position at the inner end of a port 55 extending inwardly from the fitting lengthwise of the lock screw. A plug 56 of plastic or other suitable material is sealably slidable within the hole 43 between an inner limited position determined by a snap ring 57 within the hole 43 near its inner end and an outer limited position determined by means of a snap ring 58 within the hole near its outer end.

With the rams in their open positions and the lock screws withdrawn, as shown in FIGS. 3A and 3B, grease may be injected through fitting F into the chamber 38 and hole 43 so as to move the plug 56 to its inner limited position as it engages with the split ring 57, as shown in FIG. 2, for example. Upon movement of the rams to closed position, the withdrawal of outer rod 37 from chamber 38 will cause the plug to slide outwardly within the hole to its outer, limited position. Thus, as previously mentioned, the volume displaced by the plug is essentially equal to that displaced by the outer rod in the outer chamber.

With the rams closed, each lock screw 44 may be moved inwardly to the locking position shown in FIG. 4. More particularly, and as also previously described, the volume which the lock screw displaces in outer chamber 38 is substantially equal to that displaced by the plug as it moves between its inner and outer positions, so that the plug is forced to its inner position. Slots 59 are formed in the hole to bypass the plug in each of its inner and outer positions. Thus, grease is free to bypass the plug when the plug is first moved into its inner limited position by the injection of grease through the fitting F. Slots 60 are also formed in the hole 43 near the outer end thereof, so that as the plug 56 moves into its outer limited position, fluid on its inner side may bypass the plug and fill any voids within the chamber 38. Any well fluid which has been drawn into the hole 43 and chamber 38 during this extension and retraction of the lock screw, will be displaced of course upon subsequent injection of grease into the chamber 38 and the hole 43 prior to subsequent closing of the ram and movement of the lock screw into locking position.

The housing 11 is, as previously described, made up of a main body 45, in which the bore 12 and inner end of ram chamber 17 is formed at its intersection with the bore, and bonnets 46 hingedly connected to one side of the main body for swinging between the closed positions shown in the drawings and open positions approximately 90° to one side of those illustrated. Prior to swinging of the bonnets to their open positions, the rams are withdrawn, as shown in FIGS. 2 and 3A, so that their inner ends will clear the open ends of the chambers in the preventer body. However, with the bonnets open, the rams are moved from their withdrawn, outer positions to their inner positions, corresponding to their closed positions when the bonnets are closed. Thus, the outer ends of the rams will clear the open ends of the bonnet chambers as they are lifted from the "T"'s of the valve head for replacement or repair. When in closed position, the bonnets are releasably connected across the open sides of the main body by means of bolts 47 extending within recessed portions of the bonnet for threaded connection with sockets in the main body 45 of the housing above and below the inner ends of the ram chambers formed therein.

To facilitate this ram change, without external fluid connections on the preventer housing, fluid connection between the cylinder of the operating system and the external source of hydraulic fluid is maintained in all positions of the bonnet relative to body 45. More particularly, and as also previously described, the bonnets 46, including the ram chamber, the operating system for the ram, and the conduits through which hydraulic fluid is caused to flow to and from the operating system, are identical to one another so that one can be installed in place of the other. To put it another way, each such bonnet may be installed on either the left or right hand side of the main body of the housing, as shown in the drawings, with the side to which it is connected determining only which of the side of each bonnet is disposed above the other side thereof. That is, if the bonnets were to be reversed, each would be inverted top for bottom as it is moved from one side to the other of the main body.

The outer faces of the sides of the main body of the preventer housing through which the inner ends of ram chambers 27 extend, as well as the faces of the inner ends of the bonnets surrounding the outer ends of the ram chambers, are essentially flat and move into face-to-face engagement with one another when the bonnets are swung to closed position. As shown in the drawings, each bonnet carries a gasket 70 about its face adjacent the intersection of the ram chamber therewith to form a fluid-tight seal with the adjacent face of the preventer body in closed position. Each bonnet is hingedly connected to the main body of the housing by means of a hinge pin 71 which extends through aligned holes in ears 72 which extend from one side of each bonnet for disposal within a recessed portion in the adjacent side of the main body of the preventer between flanges 73 thereof.

There are a pair of fluid conduits 74 and 75 formed in the upper and lower portions of the main body 45 for extension between the holes formed in the flanges 73 and in which the hinge pins 71 are received. These conduits are in turn intersecting by conduits in the body for connection with a source of hydraulic fluid, whereby the admission and exhaustion of such fluid to and from each of the conduits may be controlled by a suitable reversing valve.

Each of the bonnets is provided with first and second conduit means connecting the hole in the bonnet in which each hinge pin is received with the cylinder 18 on one side of the other of the piston 19. The first such conduit means comprises a single conduit 78 which intersects at its inner end with the hole in the bonnet midway of its upper and lower ends and at its outer end with the cylinder 18 on the outer side of piston 19. The second conduit means in each bonnet comprises a pair of branch conduits 79 and 80 which connect with the hole in the bonnet on opposite sides of the conduit 78 and are joined to another conduit 81 leading to cylinder 18 on the inner side of piston 19. More particularly, and consistent with the top for bottom interchangeability of one bonnet for the other, the conduits 79 and 80 of the second conduit means of the bonnets are reversed top for bottom—i.e., conduit branch 79 is above conduit branch 80 in the case of the righthand bonnet but below conduit branch 80 in the case of the lefthand bonnet.

A first conduit means in each hinge pin includes an upper axial conduit 82 having lateral ports 83A at its upper end connecting with the exterior of the hinge pin adjacent the intersection of conduit 74 in the main body with the hole for the hinge, and a lateral port 83B adjacent its lower end connecting with the exterior of the hinge pin adjacent the connection or intersection of the bonnet conduit 78 with the hole of the hinge pin in the bonnet. A second conduit means in each hinge pin includes an axial conduit 84 which is disconnected from and spaced axially below the lower end of conduit 82 and which has lateral ports 85A connecting its upper end with the exterior of the hinge pin on generally the same vertical sevel as the intersection of bonnet conduit 79 or 80 with the hole in which the hinge pin is received and lateral ports 85B connecting its lower end with the exterior thereof on generally the same vertical level as the intersection of conduit 75 in the main body of the housing with the hole therein in which the hinge pin is received. Each hinge pin is of identical construction, and thus interchangeable one for the other.

Figure 6:
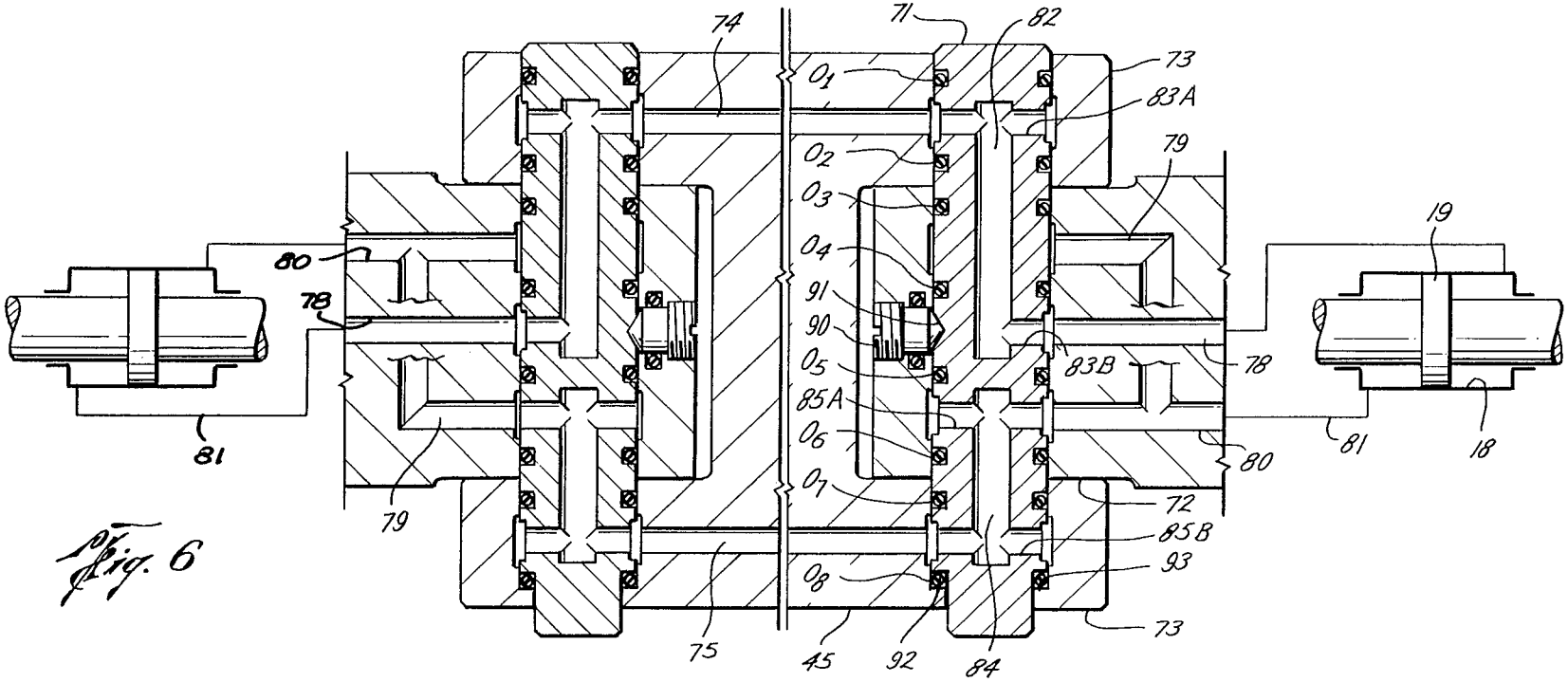
FIG. 6 is a further enlarged vertical sectional view, of the main body of the housing, the hinges connecting bonnets to the main body, and the inner ends of the bonnets, as seen along broken lines 6—6 of FIG. 5, and showing the operating fluid conduits formed therein.
Figure 7:
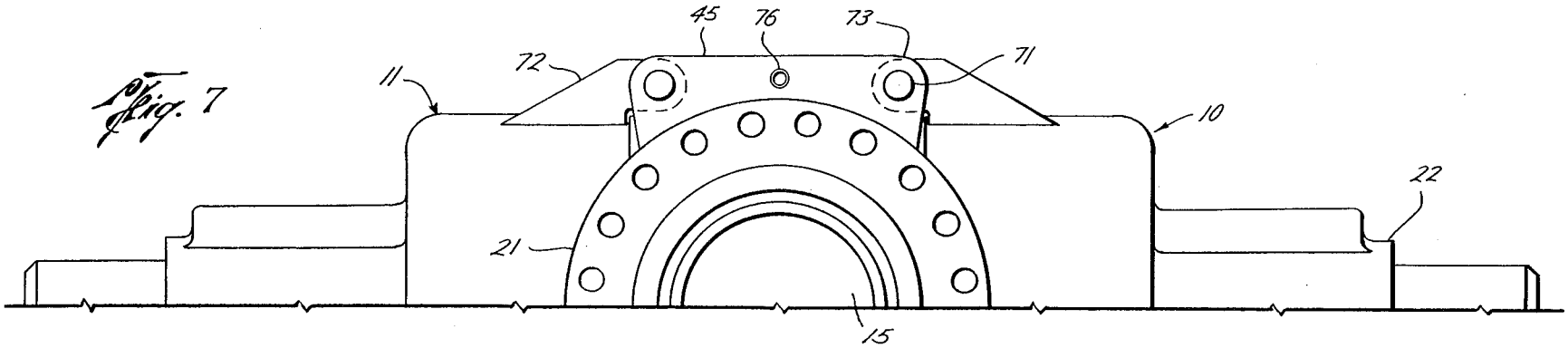
FIG. 7 is a top plan view of one-half of the blowout preventer of FIG. 5 and 6, as shown along broken lines 7—7 of FIG. 5.

More particularly, O-rings $O_1$ and $O_2$ are carried about the periphery of the right hand (FIG. 6) hinge pin for sealing with the hole for the hinge pin in the upper flange 73 above and below the intersections of conduits 74 with the hinge pin hole and the lateral ports 83A with the periphery of the hinge pin. Additional O-rings $O_3$ and $O_4$ are carried about the periphery of the hinge pin for sealing with the hole in the bonnet ear above and below the intersection therewith of conduit 79 or 80 therewith, and $O_4$ also cooperating with a further O-ring $O_5$ carried about the hinge pin for sealing above and below the intersection with the hole of conduits 78 as well as above and below lateral port 83. Another O-ring $O_6$ carried by the hinge pin seals with the hole in the bonnet beneath the lateral conduits 85A in the pin and intersection with the hole of bonnet conduit 79 or 80, and a further pair of O-rings $O_7$ and $O_8$ are carried about the periphery of the hinge pin for sealing with respect to the hole in the lower flange 73 of the main body of the preventer housing above and below the intersection of conduit 75 with the hole and lateral ports 85B in the pin.

Thus, hydraulic fluid is caused to pass between the main body conduit 74 and the cylinder 18 of each of the actuators on the outer sides of the pistons therein, and between the conduits 75 and the cylinder on the inner sides of the pistons therein. In the case of the righthand bonnet, the flow between conduit 75 and the inner end of cylinder 18 is through conduit 80, while, in the case of the lefthand bonnet, the flow between conduit 75 and the main body and the inner side of the cylinder 18 is through the conduit 79 in the bonnet. However, in the case of both bonnets, the flow between conduit 74 and the outer ends of the cylinders 18 is through the single conduit 78 in the bonnet, which of course greatly simplifies machining of the bonnets and thus the overall construction of the preventer.

However, as previously mentioned, and because of the weight of each bonnet which will impose a substantial load on the hinge pin to which it is connected, each bonnet is caused to rotate with the hinge pin as the bonnet is swung between opened and closed positions. For this purpose, a set screw 90 is threadedly mounted within the inner end of each bonnet ear 72 in order to move its inner, conical end into and out of a similarly shaped depression 91 in the side of the hinge pin. More particularly, the depression and thus the set screw are located midway of the upper and lower sides of the ear, and thus in axial alignment with conduit 78, whereby each bonnet and hinge pin is, as described, of identical construction. In addition to causing each bonnet to rotate with the hinge pin, the set screw locates the hinge pin 71 vertically within the holes of the bonnets and main body of the preventer housing. The hinge pins are located in generally the position in which they are to be locked by means of an annular shoulder 92 near the lower end of the hinge pin which rests upon O-ring $O_8$ seated on shoulder 93 about the inner periphery of the hole in which the hinge pin is received.

Figure 9:
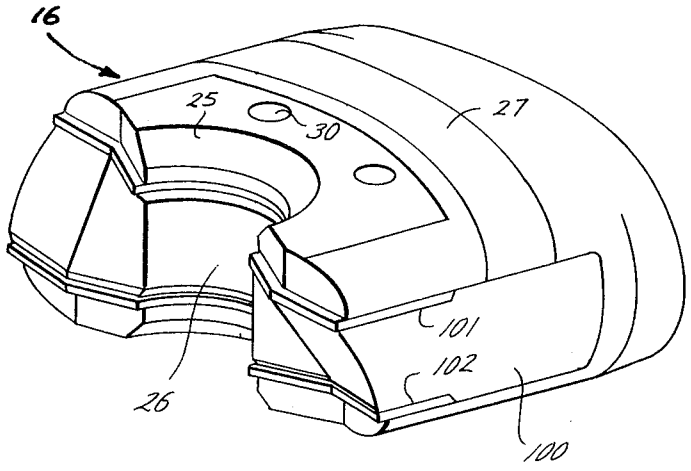
FIG. 9 is a perspective view of the front end of the ram, on an enlarged scale.
Figure 8:
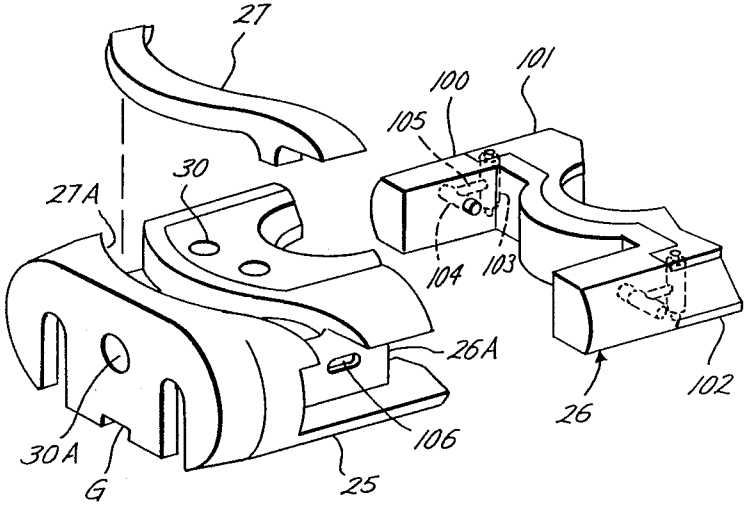
FIG. 8 is a perspective, exploded view of one of the rams, as seen from the outer, inner and one side thereof, and with the ram front and top packing removed from the recesses of the metallic ram body.

As best shown in FIG. 8 and 9, the metallic body 25 of each ram is provided with a recess which includes a portion 26A extending across its front face and along its sides rearwardly from each end of the front face so as to closely receive packing portion 26, and a portion 27A which extends across its top side intermediate its front and rear ends and connecting with the side extensions of the recess 26A so as to closely receive the top packing 27 with its opposite ends resting upon the tops of the side extensions of the ram front packing 26. As previously described, when the rams are closed, the packing is deformed to form a continuous seal which circumscribes an area on the front end, sides and top of the ram with which passageways 30 connect.

Each ram front packing 26 includes a body 100 of rubber-like material having shallow recesses on its top and bottom sides adjacent its front face so as to receive upper and lower metal retainer plates 101 and 102. More particularly, the retainer plates are molded to the packing body 100, and their top and bottom sides and inner edges are essentially flush with those of the packing body. Consequently, with the packing protruding from the front face of the metallic body 25 of the ram, the retainer plates prevent extrusion of rubber between the inner face of the metallic body 25 and the adjacent surface of the pipe or adjacent front packing of the other ram. Also, when the extrusion plates move outwardly into the packing recess, as the rams are forced tightly about a pipe and against one another, they deform the sides and top of the packing body to form a tight seal between the rams and ram chambers as well as about the pipe and between the rams.

An insert molded into each side of the body 100 of the packing comprises a generally vertically extending pin 103 connected to a generally horizontally extending pin 104 by a rearwardly extending rod 105. The reduced diameter upper and lower ends of the metal pins 103 extend into the recessed portions on the upper and lower sides of the packing body 100 and fit closely within holes in the upper and lower retainer plates 100 and 102. The inner end of each of the pins 104 projects beyond the inner face of the adjacent side portion of the packing body 100 and fits within the inner end of an elongated slot 106 in the side portion of the ram body recess 26A to permit the pin 103 to move outwardly with the retainer plates.

As best shown in FIG. 9, as well as in FIGS. 2, 2A and 3A, the portion of the ram front packing in which the semi-circular recess is formed protrudes slightly from the semi-circular recess formed in the retainer plates. Thus, the semi-circular recess in the ram front packing is sized to fit closely about the pipe and will be the first portion of the ram to engage the pipe as the ram is moved to closed position. The deformation of this protruding portion of the ram front packing within the recess will of course deform the inner face of the ram front packing on opposite sides of the recess. During this time, the inner edges of the extrusion plates on opposite sides of the pipe recesses therein, as well as within the recesses themselves, will prevent extrusion of the packing material. Also, as the protruding portion of the packing material within the recess of the ram front packing is worn, the retainer plates are free to compensate for this wear and continue to prevent extrusion due to the freedom of movement of the pins 104 within the slots 106.

As previously described, and as best shown in FIG. 9, the slanted portions of the inner edges of each retainer plate are oppositely inclined on each side of the pipe recesses as well as with respect to those of the other plate on the same side of the recess. Thus, with reference to the lefthand side of the front of the ram shown in FIG. 9, the inner face of the ram body as well as the inner edge of the upper retainer plate on the left side of the pipe recess include a portion adjacent the recess which slants outwardly and a portion adjacent the left side of the ram which slants inwardly, at the same acute angle, with respect to a plane perpendicular to the axis of movement of the ram. On the other hand, corresponding portions on the right side of the pipe recess, as well as on the left side of the recess in the lower retainer plate, slant in opposite directions—i.e., inwardly and outwardly with respect to the inner end of the ram. The front faces of the packing body are skewed to form a smooth transition between the inner edges of the upper and lower retainer plates to which they are molded. Thus, the opposed rams are of identical construction and interchangeable with one another merely upon being turned 180°—i.e., end for end.

As will be appreciated, these skewed faces of the inner ends of the rams will perform their desired function in guiding a pipe into an axially aligned position within the bore of the preventer as the rams are moved to closed position. In addition, however, their reversely slanted inner edges of the retainer plates will minimize the extent to which the outer end of the portion of the ram chamber within the main body of the preventer housing need be enlarged, such as shown at 110 in FIG. 3A, since the axis of rotation of hinge pin 81 is a minimum distance from the outermost point on the side of the ram.

In the manufacture of the ram front packing 26, the holes in the retainer plates are installed on the reduced ends 103 of the inserts, and then held within a rig as the body of the packing is molded to the plates and inserts. As previously noted, this molding of the ram front packing is totally independent of the fabrication of the ram body 25, so that the elongated slots 106 in which the inner ends of the pins 104 are received is free of extraneous packing material. In addition, the ram front packing is assembled on or removed from the ram body merely by spreading of the rearwardly extending sides thereof a sufficient distance to move the inner ends of the pins into or out of the slots 106. This, of course, may be done whether or not the top packing 27 is in place within the recess portion 27A.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A blowout preventer, comprising a housing having a bore therethrough and chambers which intersect the bore, rams reciprocable within the chambers between bore opening and closing positions, means connecting the bore of the housing beneath the closed rams with the chambers behind the closed rams so that fluid in the bore urges the rams closed, passageways in the rams connecting the chambers behind the closed rams with the bore of the housing above the closed rams, and means for reciprocating the rams between opened and closed positions, including a cylinder within the housing outwardly of each ram chamber therein, a piston reciprocable within the cylinder, a rod on the piston extending sealably through a wall of the housing separating the ram chamber from the cylinder, means by which control fluid may be admitted to or exhausted from the cylinder on opposite sides of the piston in order to selectively move the rod toward or away from the ram in the chamber, means providing a lost motion connection between the inner end of each rod and the ram so as to move the ram to closed position as the rod is moved inwardly and to move the ram to open position as the rod is moved outwardly, the inner end of each rod having means thereon for closing the connection of the passageway with the outer end of each ram as it is moved inwardly and for opening the connection of the passageway therewith as it is moved outwardly, another rod on each piston extending sealably through a wall of the housing separating the cylinder from an outer chamber in the housing, and a hole extending through the piston and both of the rods to connect the outer chamber with the ram chamber when the passageway connection is open and connect the outer chamber with the bore above the closed rams when the passageway connection is closed.

2. A blowout preventer of the character defined in claim 1, wherein the passageway in each ram is of larger minimum cross-sectional area than that of the connecting means.

3. A valve, comprising a housing having a bore therethrough and a chamber which intersects the bore, a closure member reciprocable within the chamber between bore opening and closing positions, means connecting the bore of the housing beneath the closed member with the chamber behind the member so that fluid in the bore urges the member closed, a passageway in the member connecting the chamber behind the closed member with the bore of the housing above the member, and means for reciprocating the member between opened and closed positions, including a cylinder within the housing outwardly of the chamber therein, a piston reciprocable within the cylinder, a rod on the piston extending sealably through a wall of the housing separating the chamber from the cylinder, means by which control fluid may be admitted to or exhausted from the cylinder on opposite sides of the piston in order to selectively move the rod toward or away from the member in the chamber, and means providing a lost motion connection between the inner end of the rod and the member so as to move the member to closed position as the rod is moved inwardly and to move the member to open position as the rod is moved is moved outwardly, the inner end of the rod having means thereon for closing the connection of the passageway with the outer end of the member as it is moved inwardly and for opening the connection of the passageway therewith as it is moved outwardly, another rod on the piston extending sealably through a wall of the housing separating the cylinder from an outer chamber in the housing, and a hole extends through the piston and both of the rods to connect the outer chamber with the chamber when the passageway connection is open and connect the outer chamber with the bore above the closed member when the passageway connection is closed.

4. A valve of the character defined in claim 3, wherein the passageway in the closure member is of larger minimum cross-sectional area than that of the connecting means.

5. A blowout preventer, comprising a housing having a bore therethrough and chambers which intersect the bore, rams reciprocable within the chambers between bore opening and closing positions, means connecting the bore of the housing beneath the closed rams with the chambers behind the closed rams so that fluid in the bore urges the rams closed, passageways in the rams connecting the chambers behind the closed rams with the bore of the housing above the closed rams, and means for reciprocating the rams between opened and closed positions, including a cylinder within the housing outwardly of each ram cylinder therein, a piston reciprocable within the cylinder, a rod on the piston extending sealably through a wall of the housing separating the ram chamber from the cylinder, means by which control fluid may be admitted to or exhausted from the cylinder on opposite sides of the piston in order to selectively move the rod toward or away from the ram in the chamber, means providing a lost motion connection between the inner end of each rod and the ram so as to move the ram to closed position as the rod is moved inwardly and to move the ram to open position as the rod is moved outwardly, the inner end of each rod having means thereon for closing the connection of the passageway with the outer end of each ram as it is moved inwardly and for opening the connection of the passageway therewith as it is moved outwardly, said housing comprising an inner body in which the bore and inner ends of the ram chambers are formed, bonnets in which the outer ends of the ram chamber and the cylinders are formed, and means connecting the bonnets to the inner bodies for movement between a closed position and an open position whereby, when the bonnets are in open position, the rams may be moved by said rods to positions removed from the bonnets and the inner body, said lost motion connection comprising vertically interfitting parts on opposite sides of the passageway in each ram which permit the rams to be lifted from connection with the inner ends of the rods when so removed from the bonnet and the inner body.

6. A blowout preventer of the character defined in claim 5, wherein the passageway in each ram is of the larger minimum cross-sectional area than that of the connecting means.

7. A valve, comprising a housing having a bore therethrough and a chamber which intersects the bore, a closure member reciprocable within the chamber between bore opening and closing position, means connecting the bore of the housing beneath the closed chamber with the chamber behind the member so that fluid in the bore urges the member closed, a passageway in the member connecting the chamber behidn the closed member with the bore of the housing above the member, and means for reciprocating the member between opened and closed positions, including a cylinder within the housing outwardly of the chamber therein, a piston reciprocable within the cylinder, a rod on the piston extending sealably through a wall of the housing separating the chamber from the cylinder, means by which control fluid may be admitted to or exhausted from the cylinder on opposite sides of the piston in order to selectively move the rod toward or away from the member in the chamber, and means providing a lost motion connection between the inner end of the rod and the member so as to move the member to closed position as the rod is moved inwardly and to move the member to open position as the rod is moved outwardly, the inner end of the rod having means thereon for closing the connection of the passageway with the outer end of member as it is moved inwardly and for opening the connection of the passageway therewith as it is moved outwardly, said housing comprising an inner body in which the bore and inner end of the chamber are formed, a bonnet in which the outer ends of the chamber and the cylinder are formed, and means connecting the bonnet to the housing for movement between closed position and an open position, whereby, when the bonnet is in open position, the member may be moved by said rod inwardly to a position removed from the bonnet and inner body, said lost motion connection comprising vertically interfitting parts on opposite sides of the passageway which permit the member to be lifted form connection with inner end of the rod when so removed from the bonnet and inner body.

8. A valve of the character defined in claim 7, wherein the passageway in the closure member is of larger minimum cross-sectional area than that of the connection means.

9. A blowout preventer, comprising a housing having a bore therethrough and chambers which intersect the bore, rams reciprocable within the chambers between bore opening and closing positions, means connecting the bore of the housing beneath the closed rams with the chambers behind the closed rams so that fluid in the bore urges the rams closed, passageways in the rams connecting the chambers behind the closed rams with the bore of the housing above the closed rams, and means for reciprocating the rams between opened and closed positions, including a cylinder within the housing outwardly of each ram chamber therein, a piston reciprocable within the cylinder, a rod on the piston having an inner end extending sealably through a wall of the housing separating the ram chamber from the cylinder, means by which control fluid may be admitted to or exhausted from the cylinder on opposite sides of the piston in order to selectively move the rod toward or away from the ram in the chamber, and means providing a lost motion connection between the inner end of each rod and the ram so as to move the ram to closed position as the rod is moved inwardly and to move the ram to open position as the rod is moved outwardly, each ram passageway having an opening to the ram chamber in substantial axial alignment with the rod, a valve head on the inner end of the rod engageable with a seat on the ram about the opening to close the connection of the passageway with the outer end of the ram, as the rod is moved inwardly, and movable away from the seat to open the connection of the passageway therewith, as the rod is moved outwardly, another rod on each piston having an outer end extending sealably through a wall of the housing separating the cylinder from an outer chamber in the housing, and a hole extending through the piston and both of the rods to connect the outer chamber with the ram chamber when the passageway is open and connect the outer chamber with the bore above the closed rams when the passageway is closed.

10. A blowout preventer of the character defined in claim 9, wherein each valve head carries an annular packing for engaging the seat.

11. A blowout preventer of the character defined in claim 9, wherein an annular packing is carried by one of the ram seat and valve head for engaging the other about an inner diameter substantially equal to the outer diameters of the ends of the rods which extend through the housing walls.

12. A blowout preventer of the character defined in claim 11, wherein the annular packing is carried by the valve head.

13. A blowout preventer of the character defined in claim 9, including stop means on each ram and the housing engageable with one another to limit closing movement of said ram and prevent full inward move of the piston connected thereto.

14. A blowout preventer of the character defined in claim 13, wherein the passageway in each ram is of larger minimum cross-sectional area than that of the connecting means.

15. A blowout preventer of the character defined in claim 9, wherein the passageway in each ram is of larger minimum cross-sectional area than that of the connecting means.

16. A valve, comprising a housing having a bore therethrough and a chamber which intersects the bore, a closure member reciprocable within the chamber between bore opening and closing positions, means connecting the bore of the housing beneath the closed member with the chamber behind the closed member so that fluid in the bore urges the member closed, a passageway in the member connecting the chamber behind the closed member with the bore of the housing above the closed member, and means for reciprocating the member between opened and closed positions, including a cylinder within the housing outwardly of the chamber therein, a piston reciprocable within the cylinder, a rod on the piston having an inner end extending sealably through a wall of the housing separating the chamber from the cylinder, means by which control fluid may be admitted to or exhausted from the cylinder on opposite sides of the piston in order to selectively move the rod toward or away from the member in the chamber, and means providing a lost motion connection between the inner end of each rod and the member so as to move the member to closed position as the rod is moved inwardly and to move the member to open position as the rod is moved outwardly, said passageway having an opening to the chamber in substantial axial alignment with the rod, a valve head on the inner end of the rod engageable with a seat on the member about the opening to close the connection of the passageway with the outer end of the member, as the rod is moved inwardly, and movable away from the seat to open the connection of the passageway therewith, as the rod is moved outwardly, another rod on each piston having an outer end extending sealably through a wall of the housing separating the cylinder from an outer chamber in the housing, and a hole extending through the piston and both of the rods to connect the outer chamber with the ram chamber when the passageway is open and connect the outer chamber with the bore above the closed member when the passageway is closed.

17. A valve of the character defined in claim 16, wherein the valve head carries an annular packing for engaging the seat.

18. A valve of the character defined in claim 16, wherein an annular packing is carried by one of each of the member seat and valve head for engaging the other about an inner diameter substantially equal to the outer diameters of the ends of the rods which extend the housing walls.

19. A valve of the character defined in claim 18, wherein the annular packing is carried by the valve head.

20. A valve of the character defined in claim 16, including stop means on the member and housing engageable with one another to limit closing movement of the member and prevent full inward movement of the rod connected thereto.

21. A valve of the character defined in claim 20, wherein the passageway in the closure member is of larger minimum cross-sectional area than that of the connecting means.

22. A valve of the character defined in claim 16, wherein the passageway in the closure member is of larger minimum cross-sectional area than that of the connection means.

23. A blowout preventer, comprising a housing having a bore therethrough and chambers which intersect the bore, rams reciprocable within the chambers between bore opening and closing positions, means connecting the bore of the housing beneath the closed rams with the chambers behind the closed rams so that fluid in the bore urges the rams closed, passageways in the rams connecting the chambers behind the closed rams with the bore of the housing above the closed rams, and means for reciprocating the rams between opened and closed positions, including a cylinder within the housing outwardly of each ram chamber therein, a piston reciprocable within the cylinder, a rod on the piston having an inner end extending sealably through a wall of the housing separating the ram chamber from the cylinder, means by which control fluid may be admitted to or exhausted from the cylinder on opposite sides of the piston in order to selectively move the rod toward or away from the ram in the chamber, and means providing a lost motion connection between the inner end of each rod and the ram so as to move the ram to closed position as the rod is moved inwardly and to move the ram to open position as the rod is moved outwardly, each ram passageway having an opening to the ram chamber in substantial axial alignment with the rod, and a valve head on the inner end of the rod engageable with a seat on the ram about the opening to close the connection of the passageway with the outer end of the ram, as the rod is moved inwardly, and movable away from the seat to open the connection of the passageway therewith, as the rod is moved outwardly, said housing comprising an inner body in which the bore and inner ends of the ram chambers are formed, bonnets in which the outer ends of the ram chamber and the cylinders are formed, and means connecting the bonnets to the inner body for movement between closed position and an open position, whereby when the bonnets are in open position, the rams may be moved by said rods to positions removed from the bonnets and the inner body, said lost motion connection comprising parts on the rod on opposite sides of the valve head thereon which are adapted to vertically interfit with parts on opposite sides of the opening of the ram passageway to the ram chamber in order to permit the rams to be lifted from connection with the inner ends of the rods when so removed from the bonnet and inner body.

24. A valve, comprising a housing having a bore therethrough and a chamber which intersect the bore, a closure member reciprocable within the chamber between bore opening and closing positions, means connecting the bore of the housing beneath the closed member with the chamber behind the closed member so that fluid in the bore urges the member closed, a passageway in the member connecting the chamber behind the closed member with the bore of the housing above the closed member, and means for reciprocating the member between opened and closed positions, including a cylinder within the housing outwardly of the chamber therein, a piston reciprocable within the cylinder, a rod on the piston having an inner end extending sealably through a wall of the housing separating the chamber from the cylinder, means by which control fluid may be admitted to or exhausted from the cylinder on opposite sides of the piston in order to selectively move the rod toward or away from the member in the chamber, and means providing a lost motion connection between the inner end of the rod and the member so as to move the member to closed position as the rod is moved inwardly and to move the member to open position as the rod is moved outwardly, the passageway having an opening to the chamber in substantial axial alignment with the rod, and a valve head on the inner end of the rod engageable with a seat on the closure member about the opening to close the connection of the passageway with the outer end of the member, as the rod is moved inwardly, and movable away from the seat to open the connection of the passageway therewith, as the rod is moved outwardly, said housing comprising an inner body in which the bore and inner end of the chamber are formed, a bonnet in which the outer ends of the chamber and the cylinder are formed, and means connecting the bonnet to the inner body for movement between closed position and an open position, whereby, when the bonnet is moved to open position, the member may be moved inwardly to a position removed from the bonnet and inner body, said lost motion connection comprising parts on the closure member on opposite sides of the valve head thereon which are adapted to vertically interfit with parts on opposite sides of the opening of the passageway to the chamber in order to permit the member to be lifted from connection with the inner end of the rod when so removed from the bonnet and the inner body.

25. A blowout preventer, comprising a housing having a bore therethrough and chambers therein which intersect the bore, rams reciprocable within the chambers between bore opening and closing positions, said housing including a central body in which the bore and the inner ends of the chambers are formed, and bonnets in which the outer ends of the chambers are formed, hinge pins received within aligned holes in the housing and bonnets to permit each bonnet to swing between a closed position across the inner end of a chamber and an open position to one side thereof, and means for releasably connecting each bonnet in its closed position, and means for so reciprocating the rams including a cylinder in each bonnet, a piston having oppositely facing pressure responsive surfaces within the cylinder, and a rod connecting the piston to a ram, and conduit means through which control fluid may be passed between an external source of same and the oppositely facing surfaces of the piston in order to selectively urge said rams in opposite directions toward or away from the bore, said conduit means including first and second conduits formed in the housing body to connect at their opposite ends with the holes in said body in which the hinge pins are received, first conduit means formed in each bonnet to connect the hole therein in which the hinge pin is received midway of the ends of the hole with the pressure responsive surfaces of the pistons to urge the rams in one direction, second conduit means formed in each bonnet to connect said hole intermediate the connection therewith of the end of the first conduit means and each opposite end of said hole with the pressure responsive surfaces of the pistons to urge the rams in the opposite directions, first conduit means in each hinge pin to connect the first conduit means in the body with the first conduit means in each bonnet, and second conduit means in each hinge pin to connect the second conduit means in the body with the second conduit means in each bonnet, regardless of the position to which the bonnets have been swung, means sealing between the peripheries of the pins and the holes in which they are received longitudinally intermediate the connections of the ends of conduit means in the hinge pins with their peripheries and the connections of the ends of the conduit means in the body and bonnets with the holes, as well as between the adjacent connections of the ends of the conduit means in the body and bonnets, and additional conduits formed in the housing body to connect the first and second conduits with the exterior of the body, said hinge pins and said bonnets being so constructed as to permit each bonnet and hinge pin to be installed in place of the other.

26. A blowout preventer comprising a housing having a bore therethrough and chambers which intersect the bore, rams reciprocable within the chambers between bore opening and closing positions, means connecting the bore of the housing beneath the closed rams with the chambers behind the closed rams so that fluid in the bore urges the rams closed, and means for reciprocating the rams between opened and closed positions, including a cylinder within the housing outwardly of each ram chamber therein, a piston reciprocable within the cylinder, a rod on the piston extending sealably through a wall of the housing separating the ram chamber from the cylinder and connected to the ram in the chamber so as to move the ram to closed position as the rod is moved inwardly and to move the ram to open position as the rod is moved outwardly, and means by which control fluid may be admitted to or exhausted from the cylinder on opposite sides of the piston in order to selectively move the rod toward or away from the ram in the chamber, another rod on each piston extending sealably through a wall of the housing separating the cylinder from another chamber in the housing outwardly of the cylinder, a hole extending through the piston and both of the rods to connect the outer chamber with the bore of the housing, a fitting to permit grease to be injected into the outer chamber, a plug slidably mounted within the hole for reciprocation therein between inner and outer positions to separate well fluid from the grease, the volume displaced by the plug in moving between its inner and outer positions at least substantially equaling that displaced by the other rod upon movement within the outer chamber.

27. A valve, comprising a housing having a bore therethrough, a closure member reciprocable within the housing between bore opening and closing positions, means for reciprocating the member between opened and closed positions, including a cylinder, a piston reciprocable within the cylinder, a rod on the piston extending sealably through a wall of the housing to connect at its inner end to the member so as to move the member to closed position as the rod is moved inwardly and to move the member to open position as the rod is moved outwardly, and another rod on the piston extending sealably out of the cylinder and into another chamber in the housing outwardly of the cylinder, and a hole extending through the piston and both of the rods to connect the outer chamber with the bore of the housing, a fitting to permit grease to be injected into the outer chamber a plug slidably mounted within the hole for reciprocation therein between inner and outer positions to separate fluid in the bore from the grease the volume displaced by the plug in moving between its inner and outer positions at least substantially equaling that displaced by the other rod.

28. A blowout preventer, comprising a housing having a bore therethrough and chambers therein which intersect the bore, rams reciprocable withint the chambers between bore opening and closing positions, said housing including a central body in which the bore and the inner ends of the chambers are formed, and bonnets in which the outer ends of the chambers are formed, hinge pins received within aligned holes in the housing and bonnets to permit each bonnet to swing between a closed position across the inner end of a chamber and an open position to one side thereof, and means for releasably connecting each bonnet in its closed position, and means for so reciprocating the rams including a cylinder in each bonnet, a piston having oppositely facing pressure responsive surfaces within the cylinder, and a rod connecting the piston to a ram, and means through which operating fluid may be passed between an external source of same and the oppositely facing surfaces of the piston in order to selectively urge said rams in opposite directions toward or away from the bore, including first and second conduits formed in the housing body to connect at their opposite ends with the holes in said body in which the hinge pins are received, first conduit means formed in each bonnet to connect at one end with the hole therein in which the hinge pin is received and at their opposite end with the pressure responsive surfaces of the outer sides of the pistons to urge the rams inwardly, second conduit means formed in each bonnet to connect at one end with said hole and at the opposite end with the pressure responsive surfaces of the inner sides of the pistons to urge the rams outwardly, first and second conduit means in each hinge pin for connecting the first conduit in the body with the first conduit means in each bonnet, and the second conduit in the body with the second conduit means in each bonnet, regardless of the position to which each bonnet has been swung, means sealing between the peripheries of the pins and the holes in which they are received longitudinally intermediate the connection of the ends of first and second conduit means in the hinge pins with their peripheries and the ends of the first and second conduit means in the bonnets with the holes, and means mounted on each bonnet for extension and retraction into and out of means within the hinge pin received within the hole in the bonnet so as to cause said pin to rotate with the bonnet and fix the position of said pin against axial movement within the hole, said last-mentioned means on each bonnet and the hinge pin received in the hole thereof being symmetrical with respect to the midpoint of the hole, and said parts of said hinge pins and said bonnets which interact with the housing body and with one another being otherwise so constructed as to permit each bonnet and hinge pin to be installed in place of the other.

29. Flow controlling apparatus, comprising a body having a flowway therethrough, a member reciprocable within the body between first and second positions in which it restricts the flowway to greater or lesser extents, respectively, means for reciprocating the member between its first and second positions, including a cylinder, a piston reciprocable within the cylinder, a rod on the piston extending sealably into the body and having an inner end connected to the member so as to move the member to its first position as the rod is moved inwardly and to move the member to its second position as the rod is moved outwardly, and another rod on the piston extending sealably into a chamber outwardly of the cylinder, a hole extending through the piston and both of the rods to connect the flowway with the outer chamber, a fitting to permit grease to be injected into the outer chamber, and a plug slidably mounted within the hole for reciprocation between inner and outer positions to separate fluids in the flowway from the grease, the volume displaced by the plug in moving between its inner and outer positions at least substantially equaling that displaced by the other rod upon movement within the outer chamber.

30. Apparatus of the character defined in claim 29, including stops within the hole to prevent movement of the plug substantially beyond its inner and outer positions.

31. Apparatus of the character defined in claim 30, wherein the hole is slotted to permit grease or line fluid to bypass the plug in each of its inner and outer positions.

32. Apparatus of the character defined in claim 30, including means permitting grease or line fluid to bypass the plug in each of its inner and outer positions.

33. A blowout preventer, comprising a housing having a bore therethrough and chambers which intersect the bore, rams reciprocable within the chambers between bore opening and closing positions, hydraulically operable means for so reciprocating each ram including a cylinder and a piston in the cylinder having a rod which is connected to the ram for moving the ram inwardly with the rod to closed position and outwardly with the rod to opened position, means for sealing between the inner ends of the rams and between each ram and its chamber when the rams are closed, first and second passageway means which connect the bore on opposite sides of the sealing means on the inner ends of the closed rams with the chamber behind at least one ram, the first passageway means extending through said one ram, the connection of said one ram to its rod having lost motion, and one of said one ram and rod having packing means thereon which, in response to outward and inward movement of the rod is respectively sealably engagable with and disengagable from the other to surround the opening of the first passageway means into the chamber, and stop means on each ram and the housing engagable with one another for preventing closing movement of the inner end of each ram substantially beyond the axis of the bore, the stop means on said one ram being engagable with the stop means on the housing before the piston of the hydraulically operable means therefore reaches the limit of its inward movement.

34. A blowout preventer of the character defined in claim 33, wherein the stop means on the housing are located in the chambers

35. A blowout preventer of the character defined in claim 34, wherein the second passageway means is a groove formed in the lower side of the one ram, and the stop means on the chamber is disposed within the groove for engaging the stop means on the ram aligned with the groove.

36. A blowout preventer, comprising a housing having a bore therethrough and chambers which intersect the bore, rams reciprocable within the chambers between bore openings and closing positions, hydraulically operable means for so reciprocating each ram including a cylinder and a piston in the cylinder having a rod which is connected to the ram for moving the ram inwardly with the rod to closed position and outwardly with the rod to opened position means for sealing between the inner ends of the rams and between each ram and its chamber when the rams are closed, first and second passageway means which connect the bore on opposite side of the sealing means of the closed rams with the chamber behind each ram, the first passageway means extending through each ram, the connection of each ram and its rod having lost motion, and each ram and rod having packing means thereon which, in response to outward and inward movement of the rod, is respectively engagable with and disengagable from of the the other to surround the opening of the first passageway means into the chamber, and stop means on each ram and the housing with one another engagable for preventing closing movement of the inner end of each ram substantially beyond the axis of the bore, and before the piston of the hydraulically operable means therefore reaches the limit of its inward movement.

37. A blowout preventer of the character defined in claim 36, wherein the stop means on the housing are located in the chambers.

38. A blowout preventer of the character defined in claim 37, wherein the second passageway means in each ram is a groove formed in the lower side thereof, and the stop means on the ram aligned with the groove.

* * * * *